US006032619A

United States Patent [19]

Zhu et al.

[11] Patent Number: 6,032,619

[45] Date of Patent: Mar. 7, 2000

[54] PISTON HAVING A TUBE TO DELIVER OIL FOR COOLING A CROWN

[75] Inventors: Xiluo Zhu, Canton; Alan S. Brown, Salime, both of Mich.

[73] Assignee: Federal-Mogul World Wide, Inc., Southfield, Mich.

[21] Appl. No.: 09/116,165

[22] Filed: Jul. 16, 1998

[51] Int. Cl.[7] ..... F01P 1/04

[52] U.S. Cl. ..... 123/41.35

[58] Field of Search ..... 123/41.35, 41.16

[56] References Cited

U.S. PATENT DOCUMENTS

| | | | |
|---|---|---|---|
| 1,073,197 | 9/1913 | Westinghouse | 123/41.35 |
| 1,157,347 | 10/1915 | Ver Planck | 123/41.35 |
| 2,108,194 | 2/1938 | Church | 123/41.35 |
| 2,720,871 | 10/1955 | Morris . | |
| 2,806,750 | 9/1957 | Gehres | 123/41.35 |
| 3,070,079 | 12/1962 | Seifert . | |
| 3,314,402 | 4/1967 | Tillack | 123/41.35 |
| 3,413,963 | 12/1968 | Hellingman | 123/41.35 |
| 4,011,797 | 3/1977 | Cornet | 123/41.35 |
| 4,067,307 | 1/1978 | Hofle et al. | 123/41.35 |
| 4,180,027 | 12/1979 | Taylor | 123/41.35 |
| 4,206,726 | 6/1980 | Johnson, Jr. et al. | 123/41.35 |
| 4,581,983 | 4/1986 | Moebus | 123/41.35 |
| 4,662,319 | 5/1987 | Ayoul | 123/41.35 |
| 4,907,545 | 3/1990 | Mills | 123/41.35 |

*Primary Examiner*—Willis R. Wolfe
*Assistant Examiner*—Jason Benton
*Attorney, Agent, or Firm*—Reising, Ethington, Barnes, Kisselle, Learman & McCulloch, P.C.

[57] ABSTRACT

A piston (20) for an engine having a crown portion (22) that contains a generally closed cooling chamber (58) that communicates with a cooling fluid source by a cooling bore (74) formed in a pin ear (60, 62). A tube portion (80) is located along the cooling bore (74) and cooperates with the cooling bore (74) to provide a continuous inlet passageway (88) to the cooling chamber (58).

19 Claims, 3 Drawing Sheets

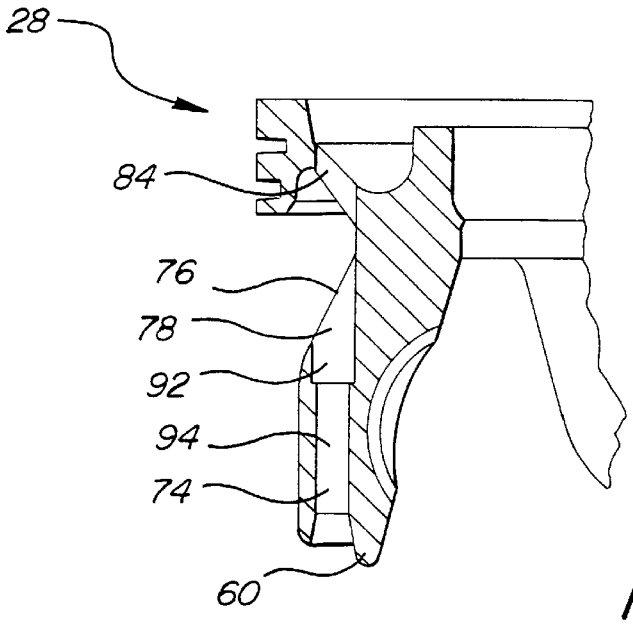
FIG-4
FIG-5
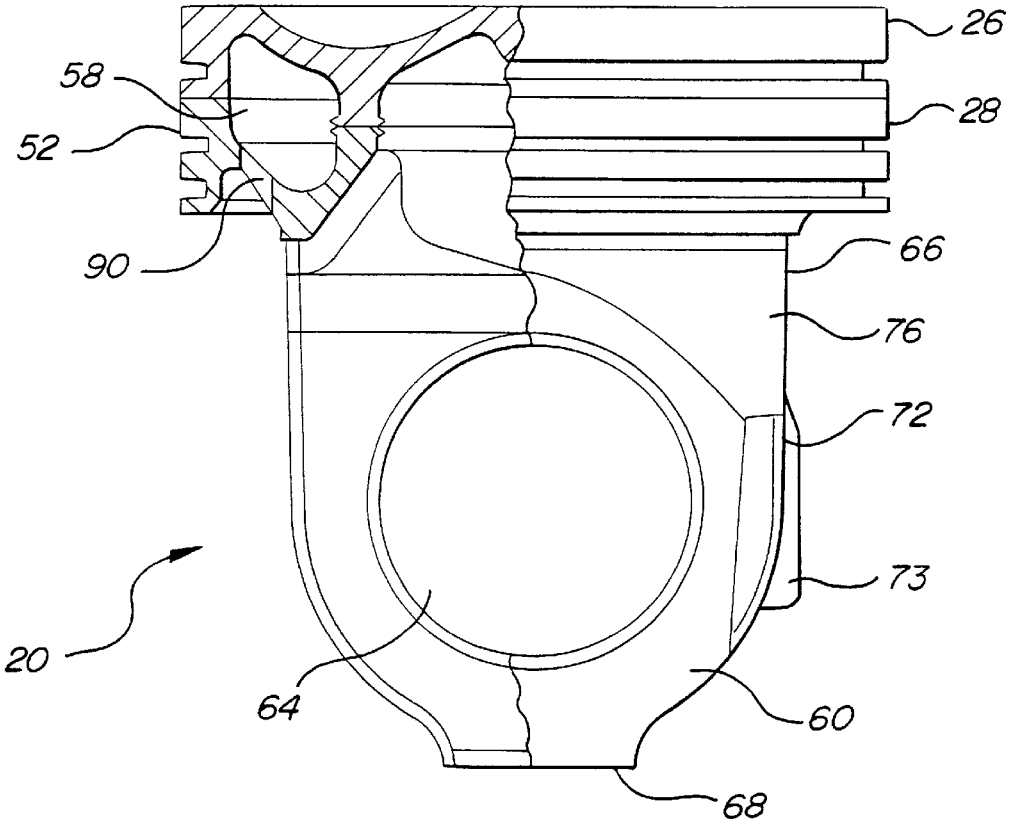

PISTON HAVING A TUBE TO DELIVER OIL FOR COOLING A CROWN

FIELD OF THE INVENTION

The present invention relates to a piston having a closed cooling chamber and in particular, to an industrial piston for internal combustion engines. The piston of the present invention includes a crown having a closed cooling chamber and a unique cooling system that delivers oil to the cooling chamber.

BACKGROUND OF THE INVENTION

Pistons have crowns that are exposed to very high temperatures and pressures produced during combustion. Piston crowns are supported by piston bodies, which have relatively more material than the piston crowns. A cylindrical skirt is either integral with, or articulated to, the piston body. The cyclic nature of combustion and the general design of pistons results in very high thermal stresses in the piston crowns. To reduce the effects of thermal stress on piston crowns, it is known to provide a cooling system. Some piston cooling systems allow generally open exposure of an underside portion of the piston crown to cooling oil that splashes upward as the piston reciprocates within a chamber.

Other known piston cooling systems have generally closed, annular cooling chambers located adjacent the piston crown and have pressurized cooling fluid, typically oil, introduced into the chamber through an inlet port communicating with an oil jet located in an engine cylinder. Thereafter, the oil is re-circulated by exiting the closed chamber through an outlet and returning to an oil reservoir in the cylinder. One known piston having a closed cooling chamber incorporates a boss that is integral with the skirt sidewall. A bore drilled in the boss has an upper end defining an inlet port of the cooling chamber and a lower end of the bore is exposed to an oil jet for introducing oil into the cooling system.

Another known cooling design provides an inlet passage passing up through a connecting rod, radially through a piston pin, around a bearing surface recess and up through passages in a support member leading to a cooling chamber. However, such a cooling design is very complex and circuitous, requiring passages or bores in almost every component which results in increased manufacturing costs.

Another known location for a piston cooling passage is vertically through a pin boss leading up to a cooling chamber. However, pistons having cooling passages in a pin boss must have sufficient cross-sectional thickness to allow drilling a continuous bore vertically through the pin boss. Pin bosses having a smaller cross-sectional thickness or an irregular cross-section have not been provided with cooling passages because drilling a bore would break through an outer surface of the pin boss, resulting in severe leakage and an unusable passage. In addition, drilling a bore in a reduced cross-sectional thickness pin boss further weakens the pin boss, increasing stress loads and decreasing piston life.

Further, engine manufacturers continually seek to decrease the weight of their engines, including reducing the weight of component parts, such as pistons. At the same time, engine designers are unable to reposition the cooling nozzle jets because of space constraints. Therefore, pistons must be designed that are lighter in weight yet still have a main feature, such as a cooling passage, in generally the same location.

SUMMARY OF THE INVENTION

The present invention is directed to a piston for use in internal combustion engines including a piston crown portion defined by an upper crown connected to a lower crown. An annular cooling chamber is located in the crown portion for providing a flow path for cooling fluid. The cooling chamber is generally closed and is substantially continuous except for a predetermined number of inlet and outlet ports. In addition, at least one piston ear projects downwardly on the lower crown, the ear includes a base and an outer tip and has a cross bore for receiving a wrist pin connected to a connecting rod. An undercut is made in the lower crown such that an undercut region is formed in the ear, near its base. A generally vertical cooling bore is located in the ear and extends toward the cooling chamber to deliver cooling fluid to the cooling chamber. However, the undercut region extends at least partially into the cooling bore such that the cooling bore includes a discontinuous portion where it meets the undercut region. Thus, any fluid would tend to flow out of the bore at the undercut region. Therefore, a tube is inserted at least partially in the cooling bore to generally cover the discontinuous portion. The tube and the cooling bore cooperate to define a generally continuous inlet passageway communicating with the cooling chamber.

Preferably, the piston of the present invention further includes a boss located on the ear to increase mechanical strength, the cooling bore being at least partially located in the boss. In addition, the cooling bore includes a first section having a first diameter and a second section having a second diameter, wherein the second diameter is smaller than the first diameter. A shoulder located between the first and second sections abuttingly engages one end of the tube and acts as an insertion stop. The cooling bore further includes a tapered section provided adjacent to at least one of the first and second sections.

Further, the tube has an outer diameter slightly smaller than the first diameter to provide either a loose fit or an interference fit in the cooling bore, depending on assembly requirements. In addition, the tube inner diameter is approximately equal to the second diameter to ensure sufficient fluid flow.

The present invention allows a piston to have reduced weight yet still enables formation of a cooling inlet passage in a pin ear. Specifically, the pin ear has insufficient material to form a continuous cooling bore at a desired location because of a weight saving undercut. However, the present invention permits a cooling inlet passage to be formed by inserting a tube into the cooling bore to cover any disrupted portions of the bore.

Accordingly, the present invention avoids the costs associated with redesigning a piston and changing the location of a cooling fluid nozzle in an engine, as would otherwise be required. Thus, the present invention provides reduced piston weight without the need for major redesigning of other engine components.

BRIEF DESCRIPTION OF THE DRAWINGS

The features and inventive aspects of the present invention will become more apparent upon reading the following detailed description, claims, and drawings, of which the following is a brief description:

FIG. 4 is a partial cross sectional view taken along line 4—4 of FIG. 2.

FIG. 5 is a partial cross-sectional elevational view of the present invention.

DETAILED DESCRIPTION OF PREFERRED EMBODIMENTS

Figure 1:
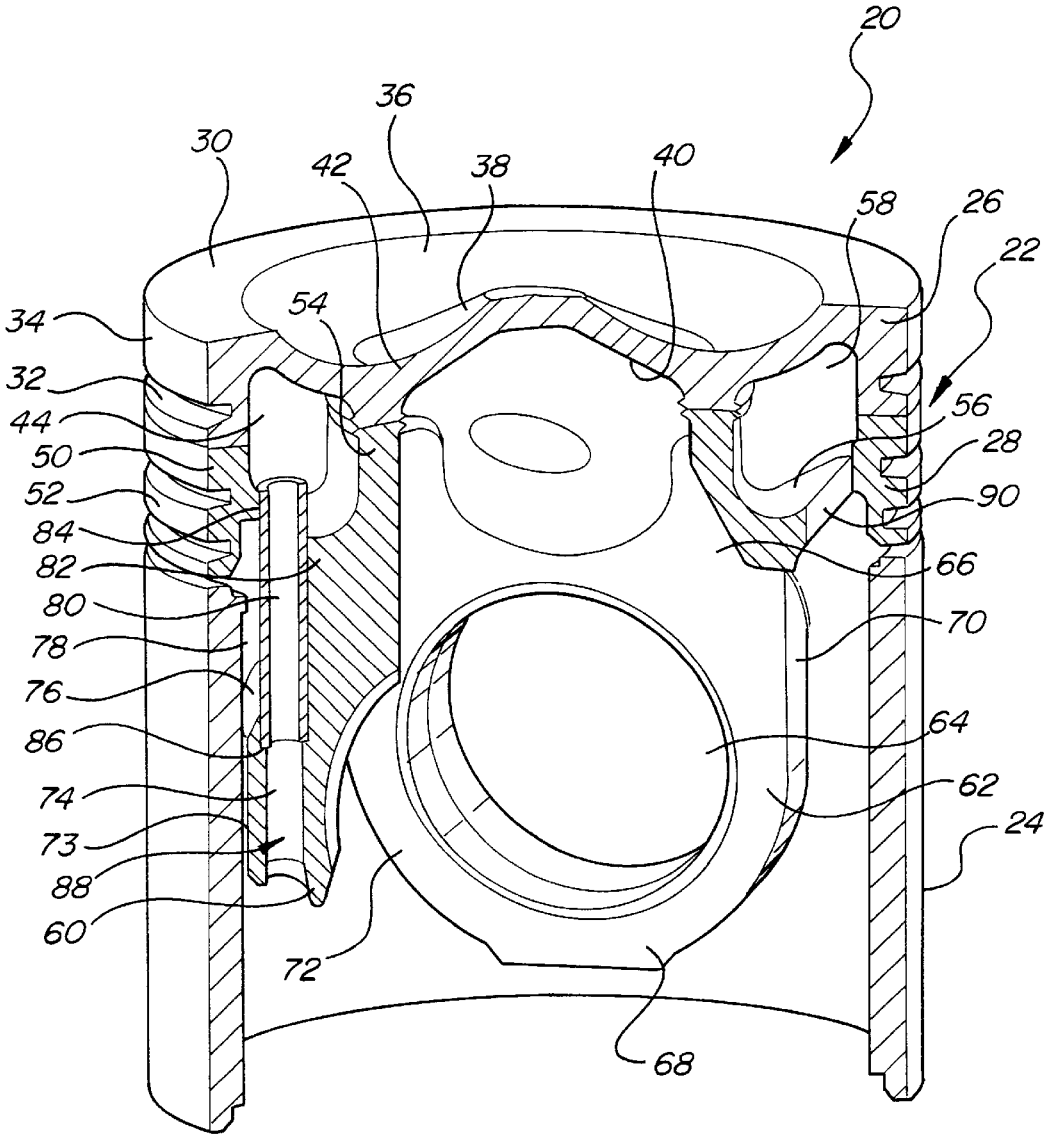
FIG. 1 is a partially sectioned perspective view of a piston according to the present invention.

FIG. 1 shows a piston 20 for use in internal combustion engines. Piston 20 is of the articulating type having a crown portion 22 separate from a skirt 24. Crown portion 22 includes an upper crown 26 connected to a lower crown 28, as for example, by friction welding. However, any suitable connecting techniques (e.g. fastening) may be employed. Upper crown 26 has an annular outer ring member 30 with a piston ring groove 32 on its outer sidewall 34. A combustion bowl 36 is located interior of outer ring member 30 and has an undulating upper surface 38 and a corresponding lower surface 40. In addition, an annular ridge 42 projects downwardly from lower surface 40. An annular recess 44 is formed between sidewall 34 and annular ridge 42.

As shown, lower crown 28 includes at least one annular outer ring member 50 having an outer sidewall 52 and an inner annular ridge 54 that are each positioned to align respectively with outer sidewall 34 and annular ridge 42 of upper crown 26 to facilitate friction welding. Annular ring 50 includes an annular recess 56 that is formed between sidewall 52 and annular ridge 54 for corresponding alignment with annular recess 44 of upper crown 26. Thus, annular recesses 44, 56 cooperate to define a generally continuous cooling chamber 58.

First and second pin ears 60, 62 project downwardly from lower crown 28 and each have a pin cross bore 64 for receiving a wrist pin (not shown) that is connected to a connecting rod (not shown). Pin ears 60, 62 have generally arch-shaped profiles including a base 66, a distal outer tip 68, a front face 70 and a rear face 72. In addition, first ear 60 further includes a boss 73 located on rear face 72. A generally vertical cooling bore 74 is provided in first ear 60 and extends at least partly into boss 73. Cooling bore 74 allows pressurized cooling oil from a conventional oil jet nozzle (not shown) mounted on a cylinder wall (not shown) to be directed up to cooling chamber 58. An undercut region 76 is formed in first ear 60 on rear face 72, preferably providing a weight savings advantage. The undercut region 76 is produced by a generally circumferential (either continuous or intermittent) undercut (not shown) that removes material from front and rear faces 70, 72 of pin ears 60, 62 in an effort to decrease the weight of piston 20. Preferably, piston 20 is manufactured from a steel forging to provide high strength and relatively low cost. However, any suitable materials or fabricating techniques can be used.

Undercut region 76 extends into and interrupts cooling bore 74 such that cooling bore 74 includes a discontinuous portion 78. As a result, oil flowing through cooling bore 74 would tend to flow out of the discontinuous portion 78 instead of reaching cooling chamber 58. A tube member or portion 80 is inserted into a first end 82 of cooling bore 74, near an inlet port 84 of cooling chamber 58. Tube 80 extends past discontinuous portion 78 to abut against a shoulder 86. Thus, tube 80 and cooling bore 74 cooperate to define a generally continuous inlet passageway 88 communicating with cooling chamber 58. In addition, an outlet port 90 is provided in annular recess 56 of cooling chamber 58 to facilitate drainage and recirculation of oil. Although oil is described for cooling, any suitable coolant media can be used.

Figure 2:
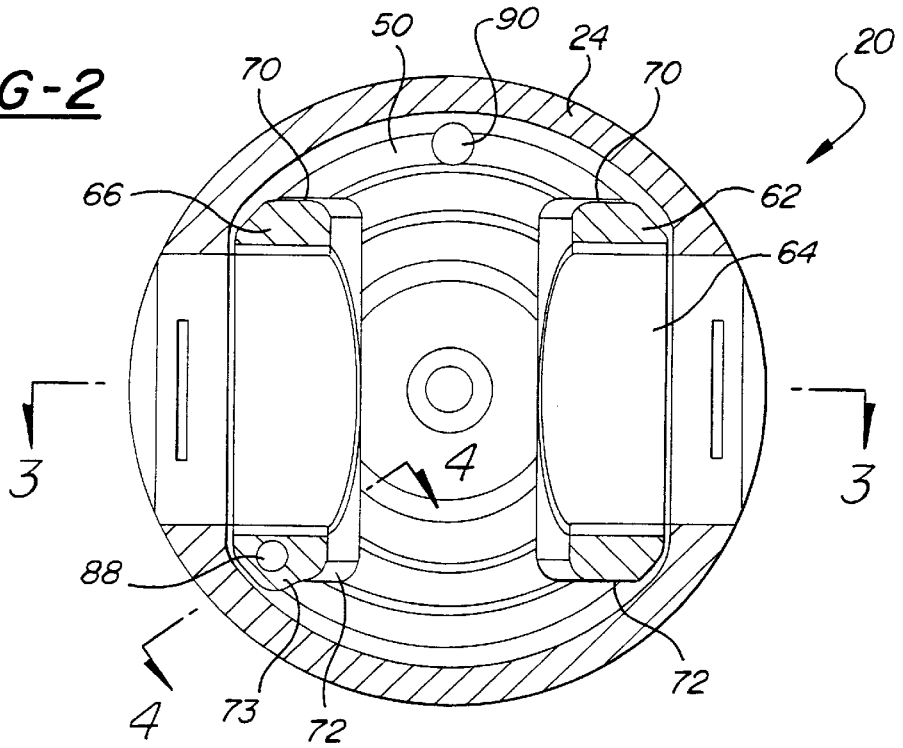
FIG. 2 is a cross-sectional plan view of a piston according the present invention.

FIG. 2 shows a cross sectional plan view of piston 20 with skirt 24 and first and second ears 60, 62 being sectioned. Boss 73 is illustrated extending outwardly from rear face 72 of first ear 60. Outlet port 90 is positioned in annular ring 50 approximately midway between first and second ears 60, 62. However, outlet port 90 can be located at any suitable location on lower crown 28. Moreover, although only one inlet passageway 88 and one outlet port 90 are illustrated, it is also contemplated that any suitable number of inlet passageways and outlet ports can be provided according to the present invention.

Figure 3:
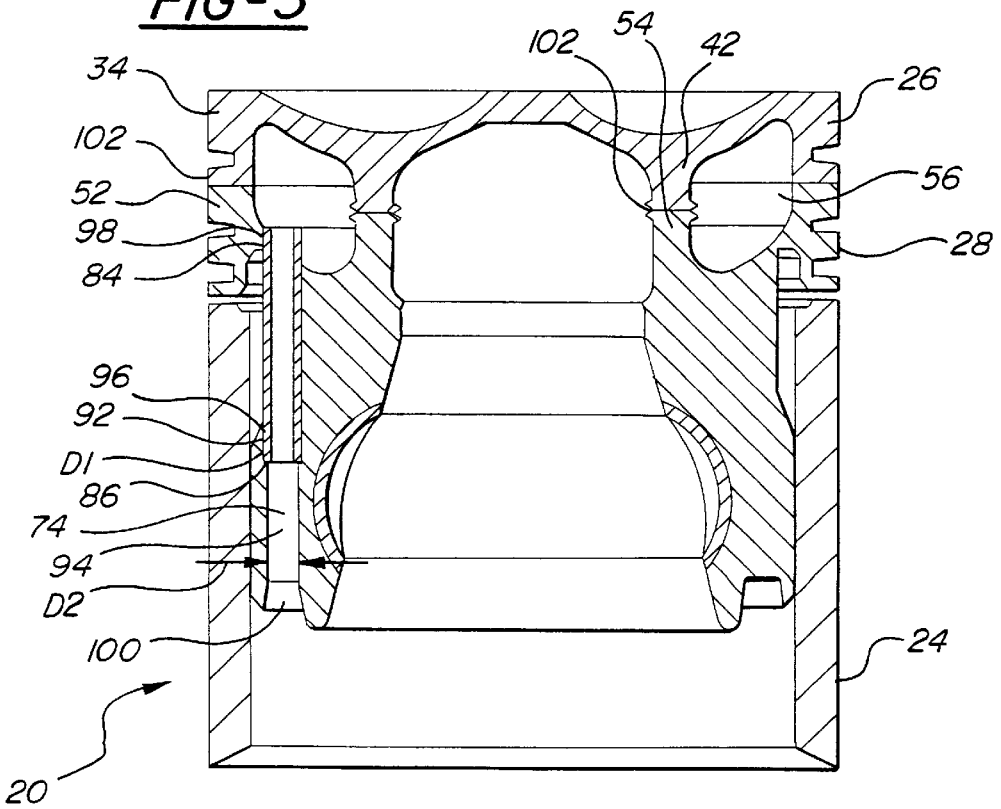
FIG. 3 is an elevational cross-section of the piston of FIG. 2 taken along line 3—3.

FIG. 3 shows a cross section of piston 20 taken through line 3—3 of FIG. 2. Cooling bore 74 includes a first section 92 having a first diameter D1 and a second section 94 having a second diameter D2. Second diameter D2 is smaller than first diameter D1 and shoulder 86 is formed at the transition between first and second sections 92, 94. As discussed above, shoulder 86 acts as a stop to limit the depth of insertion for tube 80 by abuttingly engaging one end 96 of tube 80. Opposite end 98 of tube 80 extends into cooling chamber 58 to permit an adequate level of oil to remain in cooling chamber 58 and avoid unwanted drain back through inlet passageway 88.

Next, tube 80 has an outer diameter slightly smaller than first diameter D1 to provide either a loose fit or an interference fit in cooling bore 74, depending on the desired assembly requirements. Also, tube 80 has an inner diameter that is approximately equal to second diameter D2 to ensure sufficient and even flow of oil. Cooling bore 74 further includes a tapered or flared section 100 provided adjacent to second section 94 to present an enlarged opening for oil to enter from a conventional oil nozzle jet (not shown).

Prior to friction welding upper and lower crowns 26, 28 together, tube 80 is inserted into cooling bore 74 through inlet port 84. During friction welding, flash 102 is produced at the interface between upper and lower sidewalls 34, 52 and upper and lower annular ridges 42, 54. Afterwards, a machining step is performed to remove any flash that is located on the outer surface of upper and lower sidewalls 34, 52 to provide a generally smooth outer surface. However, such machining cannot be accomplished and is not required on the interior of piston 20. Once sidewalls 34, 52 and annular ridges 42, 54 have been friction welded together, cooling chamber 58 is essentially sealed except for any inlet and outlet ports 84, 90.

FIG. 4 shows a partial cross-section taken along line 4—4 of FIG. 3 with tube 80, skirt 24 and upper crown 26 not shown for clarity. First ear 60 is shown in cross-section with second section 94 of cooling bore 74 being interrupted by undercut region 76. In the illustrated embodiment, undercut region 76 extends the full depth of bore 74. However, undercut region 76 may extend deeper or shallower into first ear 60. Also, although undercut region 76 has a generally V-shaped profile, any suitable shape is envisioned to be used, preferably affording weight savings. In addition, undercut region 76 is formed by a cutting process after initial fabrication of piston 20. However, undercut region 76 can also be formed during initial fabrication to avoid the need for a subsequent material removal operation, resulting in less scrap.

Next, FIG. 5 shows a partial cross section of piston 20 with a profile of first ear 60 and boss 73 projecting outwardly from rear face 72. Boss 73 is shown extending from base 66 approximately three fourths of the distance to outer tip 68. However, boss 73 can extend and project any suitable distances that provide its function in accordance with the present invention. Undercut region 76 is also illustrated near base 66. Further, outlet port 90 is shown as an angled opening leading into cooling chamber 58 adjacent sidewall 52 of lower crown 28.

Preferred embodiments of the present invention have been disclosed. A person of ordinary skill in the art would realize, however, that certain modifications would come within the teachings of this invention. Therefore, the following claims should be studied to determine the true scope and content of the invention.

What is claimed is:

1. A piston for use in an internal combustion engine comprising:

a crown portion having an internal cooling chamber and at least one depending ear formed with a cross bore for supporting a wrist pin;

a radially reduced undercut region formed in said ear;

a cooling bore formed in said ear and extending into said cooling chamber, said undercut region intersecting said bore to define a discontinuous section of said bore along said undercut region; and a tube member formed separately from said crown portion disposed in said bore and bridging said discontinuous section of said bore to define a continuous inlet passage communicating with said cooling chamber.

2. A piston for use in internal combustion engines comprising:

an upper crown;

a lower crown connected to said upper crown to define a crown portion a cooling chamber provided in said crown for providing a flow path for cooling fluid;

at least one ear projecting downwardly from said lower crown having a cross bore for receiving a wrist pin;

a cooling bore located in said ear and extending toward said cooling chamber;

an undercut region on an outer surface of said ear, said undercut region extending at least partially into said cooling bore such that said cooling bore includes a discontinuous portion; and a tube portion provided along said cooling bore, said tube portion and said cooling bore cooperating to define an inlet passageway communicating with said cooling chamber.

3. The piston of claim 2, wherein said tube portion (80) generally covers said discontinuous portion (78) such that said inlet passageway (88) is substantially continuous.

4. The piston of claim 2, further comprising a boss (73) located on said at least one ear (60, 62), said cooling bore (74) being at least partially located in said boss (73).

5. The piston of claim 2, wherein said cooling chamber (58) is substantially continuous except for a predetermined number of inlet (84) and outlet (90) ports.

6. The piston of claim 2, wherein said cooling bore (74) includes a first section (92) having a first diameter (D1) and a second section (94) having a second diameter (D2), wherein said second diameter is smaller than said first diameter (D1).

7. The piston of claim 6, wherein said cooling bore (74) includes a shoulder (86) located between said first and second sections (92, 94) for abuttingly engaging one end of said tube portion (80).

8. The piston of claim 6, wherein said cooling bore (74) further includes a tapered section (100) adjacent at least one of said first and second sections (92, 94).

9. The piston of claim 6, wherein said tube portion (80) has an outer diameter greater than said second diameter (D2).

10. The piston of claim 6, wherein said tube portion (80) has an inner diameter approximately equal to said second diameter (D2).

11. The piston of claim 6, wherein said tube portion (80) has an outer diameter slightly smaller than said first diameter (D1) to provide one of a loose fit or an interference fit in said cooling bore (74).

12. The piston of claim 2, wherein said tube portion (80) is located adjacent an inlet port (84) of said cooling chamber (58).

13. The piston of claim 12, wherein said tube portion (80) extends into said cooling chamber (58).

14. The piston of claim 1, wherein said upper crown (26) is friction welded to said lower crown (28).

15. A piston (20) for use in internal combustion engines comprising:

an upper crown (26);

a lower crown (28) connected to said upper crown (26) to define a crown portion (22);

a cooling chamber (58) located in said crown portion (22) for providing a flow path for cooling fluid;

at least one ear (60, 62) projecting downwardly on said lower crown (28), said ear (60, 62) including a base (66) and an outer tip (68) and having a cross bore (64) for receiving a wrist pin;

a boss (73) located on said at least one ear (60, 62);

a cooling bore (74) located in said ear (60, 62) and extending toward said cooling chamber (58), said cooling bore (74) being at least partially located in said boss (73);

a tube (80) located at least partially in cooling bore (74), said tube (80) and said cooling bore (74) cooperating to define an inlet passageway (88) communicating with said cooling chamber (58); and an undercut region (76) formed on an outer surface (70, 72) of said ear (60, 62), said undercut region (76) extending at least partially into said cooling bore (74) such that said cooling bore (74) includes a discontinuous portion (78) and said tube (80) covers said discontinuous portion (78) such that said inlet passageway (88) is substantially continuous.

16. A method of delivering fluid to a closed cooling chamber of an articulated piston having a crown portion connected to at least one pin ear, comprising the steps of:

forming a cooling bore in the at least one pin ear that extends toward the cooling chamber;

forming an undercut region in the ear intersecting the cooling bore to define a discontinuous section of the cooling bore along the undercut region; and installing a tube member in the cooling bore bridging the discontinuous section of the bore and defining a continuous inlet passageway communicating with the cooling chamber.

17. The method of claim 16, further comprising the step of inserting said tube portion (80) into said cooling bore (74).

18. The method of claim 16, further comprising the step of forming a shoulder (86) in said cooling bore (74) by forming said cooling bore (74) as a plurality of bores (92, 94) having different diameters.

19. The method of claim 16, further comprising the steps of providing an inlet (84) in said cooling chamber (58) and inserting said tube portion (80) into said cooling bore (74) through said inlet (84).

* * * * *